US008267840B2

(12) United States Patent
Barnes

(10) Patent No.: US 8,267,840 B2
(45) Date of Patent: Sep. 18, 2012

(54) MULTI-FUNCTION EXERCISE DEVICE

(76) Inventor: Neal P. Barnes, Medina, MN (US)

( * ) Notice: Subject to any disclaimer, the term of this patent is extended or adjusted under 35 U.S.C. 154(b) by 10 days.

(21) Appl. No.: 12/762,953

(22) Filed: Apr. 19, 2010

(65) Prior Publication Data

US 2010/0292058 A1 Nov. 18, 2010

Related U.S. Application Data

(60) Provisional application No. 61/170,599, filed on Apr. 18, 2009.

(51) Int. Cl.
*A63B 21/068* (2006.01)
*A63B 21/00* (2006.01)
*A63B 26/00* (2006.01)

(52) U.S. Cl. ..... 482/95; 482/131; 482/141

(58) Field of Classification Search ..... 482/38, 482/95, 96, 131, 141, 14–17, 143
See application file for complete search history.

(56) References Cited

U.S. PATENT DOCUMENTS 2,262,761 A * 11/1941 Gay ..... 482/24
3,679,203 A * 7/1972 Grana ..... 482/142
3,682,475 A * 8/1972 Walker ..... 482/140
3,734,494 A * 5/1973 Sellner ..... 482/142
3,857,561 A * 12/1974 Cecchettini et al. ..... 482/142
D300,157 S * 3/1989 Yates ..... D21/690
5,290,209 A * 3/1994 Wilkinson ..... 482/38
5,582,565 A * 12/1996 Soria ..... 482/141
7,083,558 B2 * 8/2006 Williams, Sr. ..... 482/142
7,364,530 B2 * 4/2008 Lopez ..... 482/38
7,367,928 B2 * 5/2008 Storch ..... 482/141
7,637,851 B1 * 12/2009 Lormil ..... 482/95
7,815,557 B1 * 10/2010 Almeda ..... 482/141
2004/0110608 A1 * 6/2004 Washington ..... 482/96
2006/0217246 A1 * 9/2006 Payne ..... 482/96
2009/0124471 A1 * 5/2009 Storch ..... 482/141
2010/0105532 A1 * 4/2010 Israeli ..... 482/131

* cited by examiner

*Primary Examiner* — Allana Lewin
(74) *Attorney, Agent, or Firm* — Pauly, Devries Smith & Deffner, L.L.C.

(57) ABSTRACT

The present invention is directed to an apparatus allowing a user to get an excellent whole-body work out. The invention includes a frame that has a region for completing a pull up type movement, a region for completing a push up style movement and a region for completing a dip style movement as well as variations of movements within. Additionally the assembled unit may act in a similar fashion to a ballet or balance bar to allow completion of a variety of movements and exercises.

7 Claims, 6 Drawing Sheets

17
14

13

17
18
18

MULTI-FUNCTION EXERCISE DEVICE

FIELD OF THE INVENTION

The present invention is directed to the field of exercise equipment and methods of using exercise equipment, in particular the invention is directed to exercise equipment allowing multiple exercises using numerous different muscles.

SUMMARY OF THE INVENTION

The present invention is directed to an apparatus allowing a user to get an excellent whole-body work out. The invention includes a frame that has a region for completing a pull up type movement, a region for completing a push up style movement, and a region for completing a dip style movement as well as variations of movements. Additionally the assembled unit may act in a similar fashion to a ballet or balance bar to allow completion of a variety of movements and exercises.

A platform may be added to the push up and dip region to create an elevated platform or step. An upper horizontal bar is optionally equipped with two or more suspended grips. These grips may rotate during use. The raised front bar region allows a user to perform dip and push up exercises and receives a step platform which may have foam rubber grips or other comfortable solutions for the gripping of the bars during exercises.

The configuration of the machine also allows variations on several of the key movements to allow the exercises to become easier for the user. For example, an alternative to the pull up style movement allows the user to place their buttocks on the floor and execute the pull up motion more easily by virtue of lifting less body. Additionally variations on the design of the parts may allow for other various uses such as support for legs during stretches, the creation of a sling and other variations. The abdominals may also be used with the user's body in the pull up movement position and raising the legs upward and toward the user's hands. Variations on this movement are also possible.

BRIEF DESCRIPTION OF THE DRAWINGS

The invention may be more completely understood in connection with the following drawings, in which.

Figure 1:
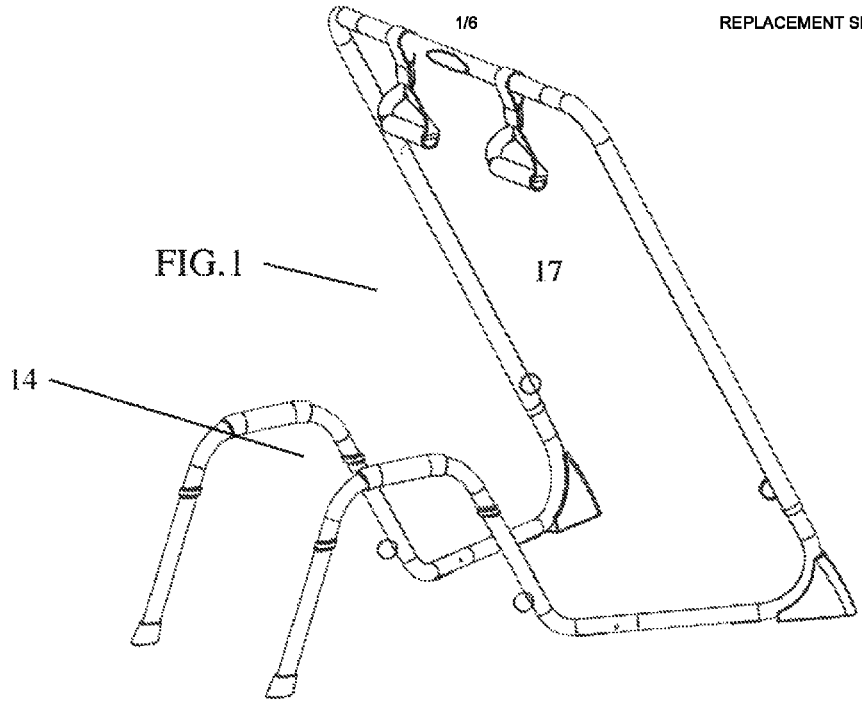
FIG. 1 shows a perspective view of an apparatus made in accordance with an implementation of the invention.

While the invention may be modified in many ways, specifics have been shown by way of example in the drawings and will be described in detail. It should be understood, however, that the intention is not to limit the invention to the particular embodiments described. On the contrary, the intention is to cover all modifications, equivalents, and alternatives following within the scope and spirit of the invention as defined by the claims.

DETAILED DESCRIPTION

Figure 2:
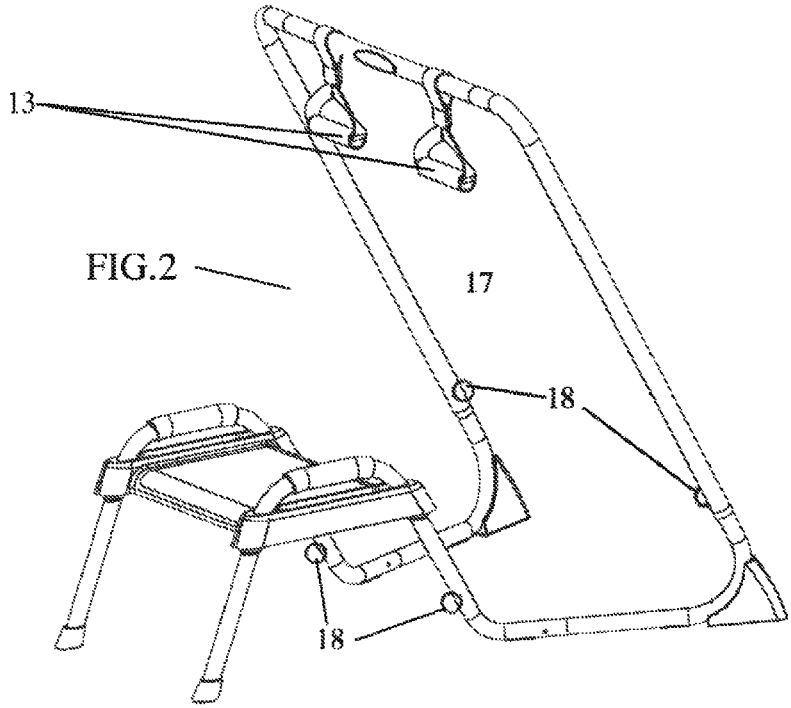
FIG. 2 shows a perspective view of an apparatus made in accordance with an implementation of the invention.
Figure 4:
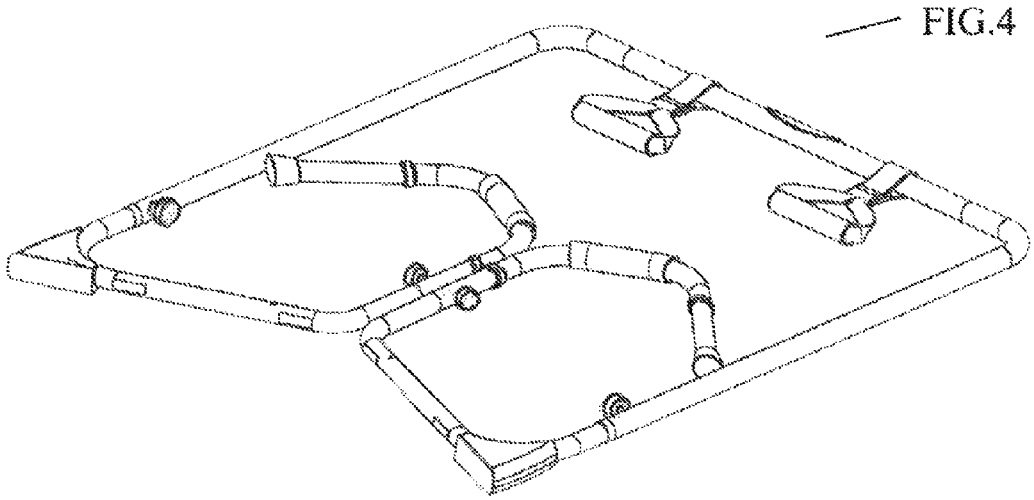
FIG. 4 shows an apparatus made in accordance with an implementation of the invention, the apparatus folded for storage or transport.

Described herein is an exercise device, as shown in FIG. 1 and FIG. 2, which allows in certain embodiments multiple exercises to be completed. The frame 1 of the device is constructed and arranged such that it can be assembled easily and fold to a flat configuration for storage, as shown in FIG. 4.

The device comprises, in certain embodiments, a frame that can vary in tube style and configuration but which has a region for completing a pull up type movement, a region for completing a push up style movement and a region for completing a dip style movement as well as variations of movements within. Additionally the assembled unit may act in a similar fashion to a ballet or balance bar to allow completion of a variety of movements and exercises.

Figure 3:
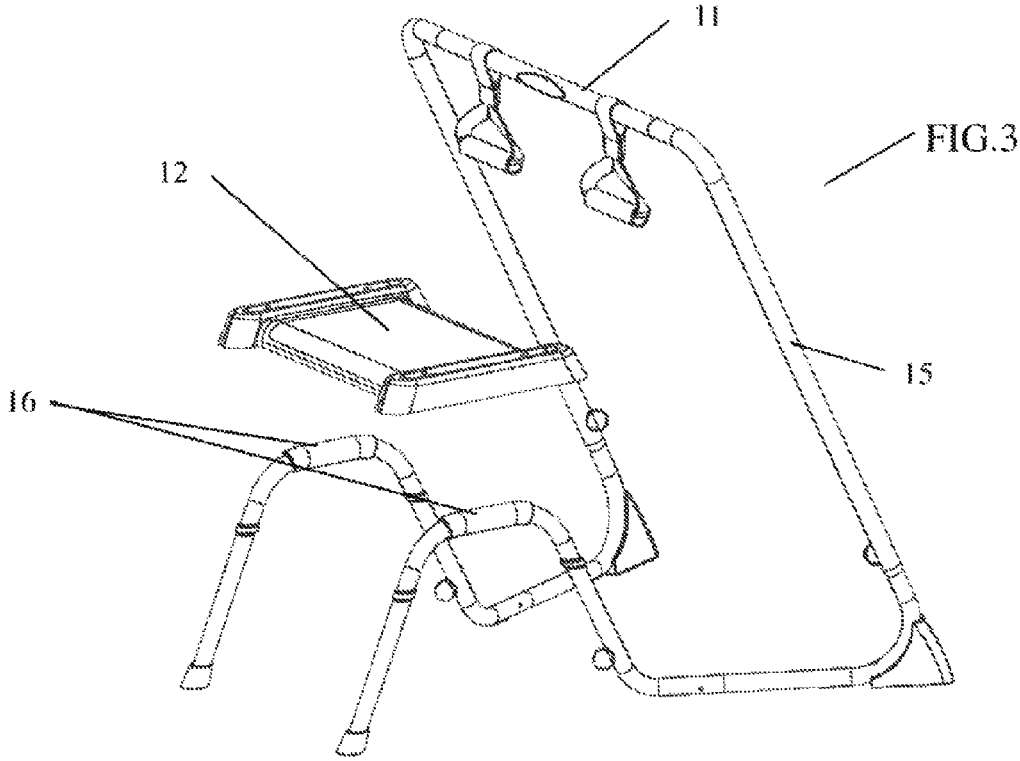
FIG. 3 shows an alternative perspective view of an apparatus made in accordance with an implementation of the invention.

A platform may be added to the push up and dip region FIG. 3 to create an elevated platform or step. This step may be used in the execution of a variety of movements including a calf raise style exercise, or a lunge style movement with one foot on the platform and one on the floor. Referring again to FIG. 3, the horizontal bar 11 may be used in conjunction with the raised platform 12 for additional exercises and movements. Additionally a softer foam matt may be used when placed along the floor about the machine for greater comfort.

The upper most horizontal bar 11 is optionally equipped with two or more suspended grips 13. These grips may rotate during use. The grips may also be adjustable in length. The grips are also allowed to be adjusted along the horizontal bar 11 to achieve different width hand positions. The material and construction of the grips may vary and can be imagined in plastic, steel or nylon webbing and foam as shown.

The raised front bar region 14 allows a user to perform dip and push up exercises and receives the step platform 12 which may have foam rubber grips 16 or other comfortable solutions for the gripping of the bars during exercises. These foam grips 16 may also be used in conjunction with the step platform in exercise variations.

Figure 5:
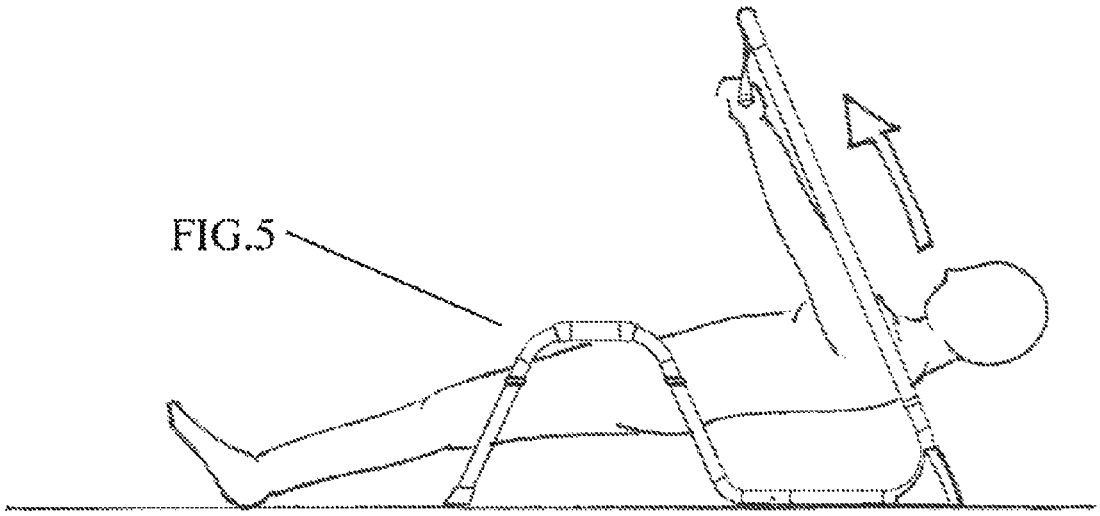
FIG. 5 shows a side view of an apparatus made in accordance with an implementation of the invention, the apparatus being used for an exercise.

The configuration of the machine also allows variations on several of the key movements to allow the exercises to become easier for the user. In a reclining pull up style movement shown in FIG. 5, the user may lay on the floor with the shoulders at the corner and arms in line with the upward support bar 15. The user may grab the pull up grips 13 and perform the movement by pulling their body upward. By virtue of a portion of the users body being placed on the floor the exercise is more easy for the user to execute, allowing greater number of repetitions. In the pull up style movement the user may chose to place their heels on the floor with the body in a straight configuration as depicted in FIG. 5.

Figure 6:
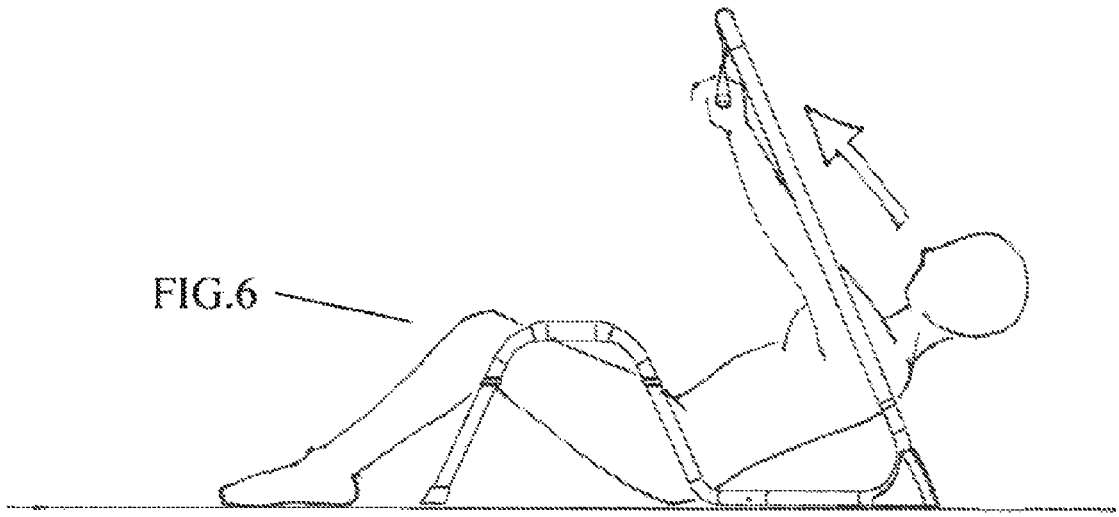
FIG. 6 shows a side view of an apparatus made in accordance with an implementation of the invention, the apparatus being used for an alternative exercise.

An alternative to the pull up style movement allows the user to place their buttocks on the floor and execute the pull up motion more easily by virtue of lifting less body weight FIG. 6. Another method would allow the user to place the feet flat on the floor and while holding the pull up grips pull the body upward keeping the knee joint at approximately 90 degrees. During any of the pull up style movements the hands may be rotated to a variety of positions to execute the exercise or rotated during the movements.

The pull up grips 13 may be used in different exercises from various positions about the machine. Additionally variations on the design of the parts may allow for other various uses such as support for legs during stretches, the creation of a sling and other variations. The abdominals may also be used with the users body in the pull up movement position and raising the legs upward and toward the users hands. Variations on this movement are also possible.

Figure 7:
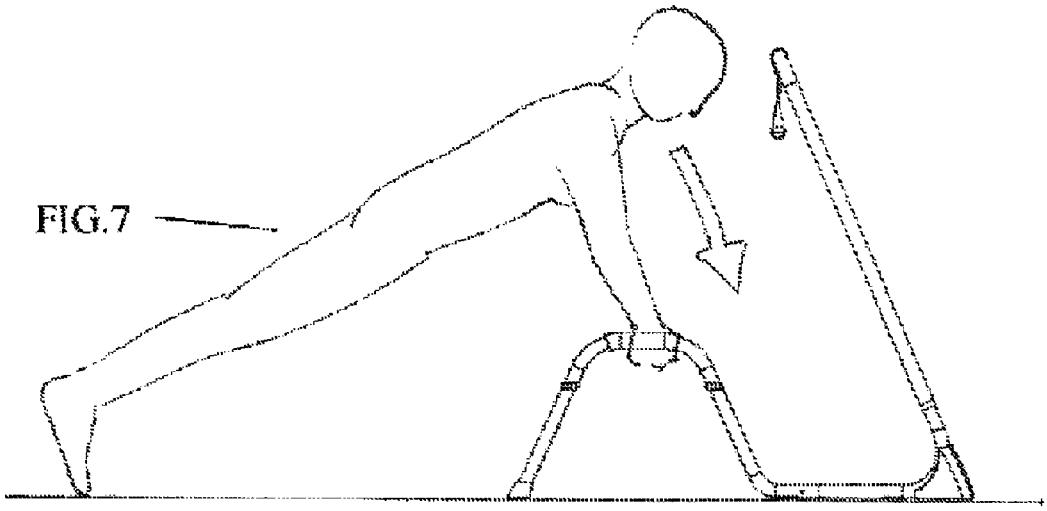
FIG. 7 shows a side view of an apparatus made in accordance with an implementation of the invention, the apparatus being used for an alternative exercise.
Figure 8:
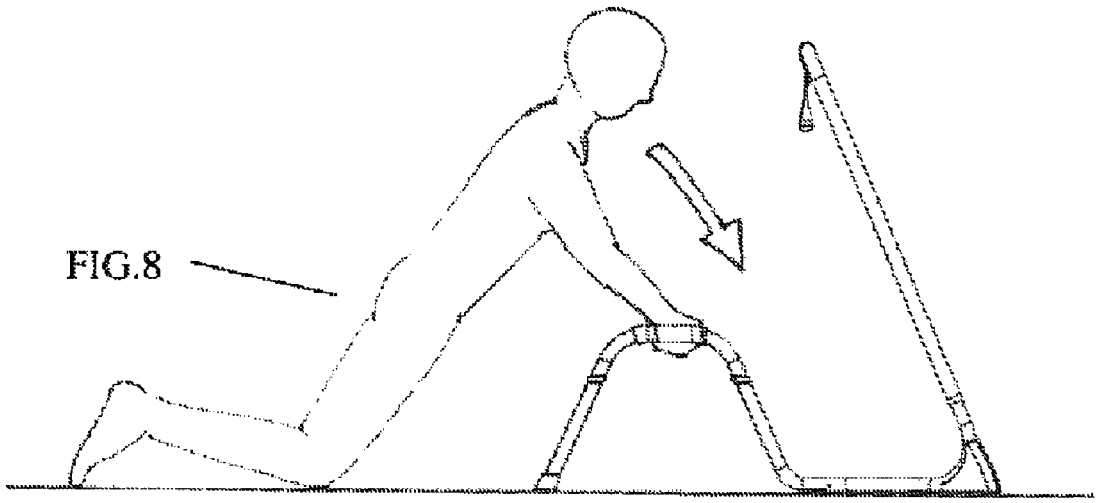
FIG. 8 shows a side view of an apparatus made in accordance with an implementation of the invention, the apparatus being used for an alternative exercise.

The raised front bar region 14 may be used for a push up style movement. In a traditional movement the hands are placed on the foam grips 16, facing downward with the body stretched outward to execute a push up style movement FIG. 7. The raised front bar allows the user to execute the movement range closer to the floor achieving a deeper motion. A variation of the movement allows the user to place the hands on the foam grips 16 with the knees in contact with the ground and performing the push up style movement FIG. 8.

This action allows the exercise to become easier by virtue of using less of the users body weight allowing greater frequency of the movement. It is the case that the raised front bar region 14 also allows the push up style movement to become more easy by virtue of creating an angle less than parallel to the floor and so less of the users body weight is being used in the motion.

Figure 9:
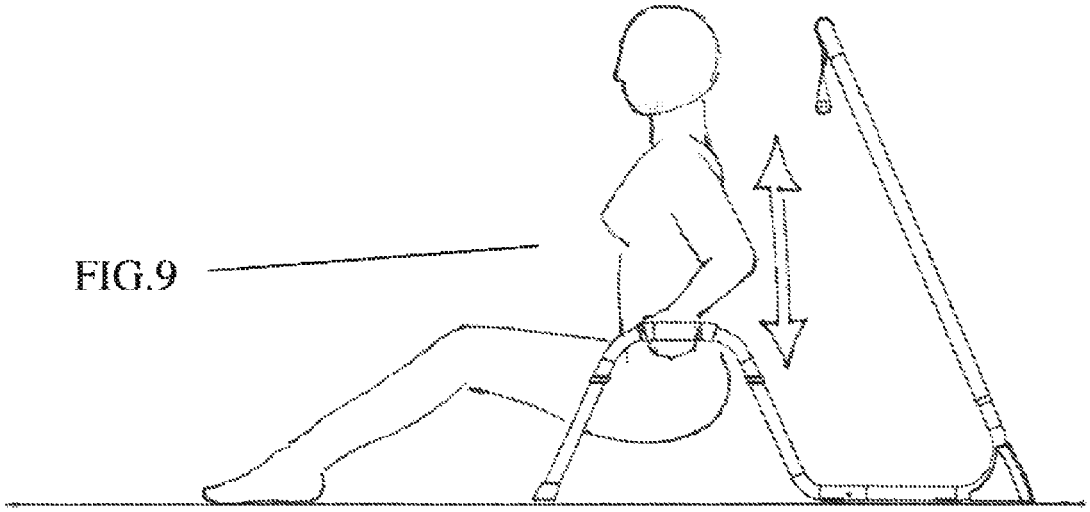
FIG. 9 shows a side view of an apparatus made in accordance with an implementation of the invention, the apparatus being used for an alternative exercise.

The front raised bar region 14 may also be used to complete a dip style movement. With the hands placed on the foam grips 16 in a seated type position and the legs extended outward the user may raise up against their body weight up and down creating a dip style movement FIG. 9. Variations on this movement may be conceived as well. By virtue of a portion of the body being in contact with the ground the dip style movement is also easier for the user to execute.

The front raised bar region 14 may also be varied by the user to create a greater or lesser space between the foam grips 16. This change may be created dynamically during exercise or adjusted to a static position. Additionally the vertical height of the front raised bar region 14 may be adjusted upward or downward.

Figure 10:
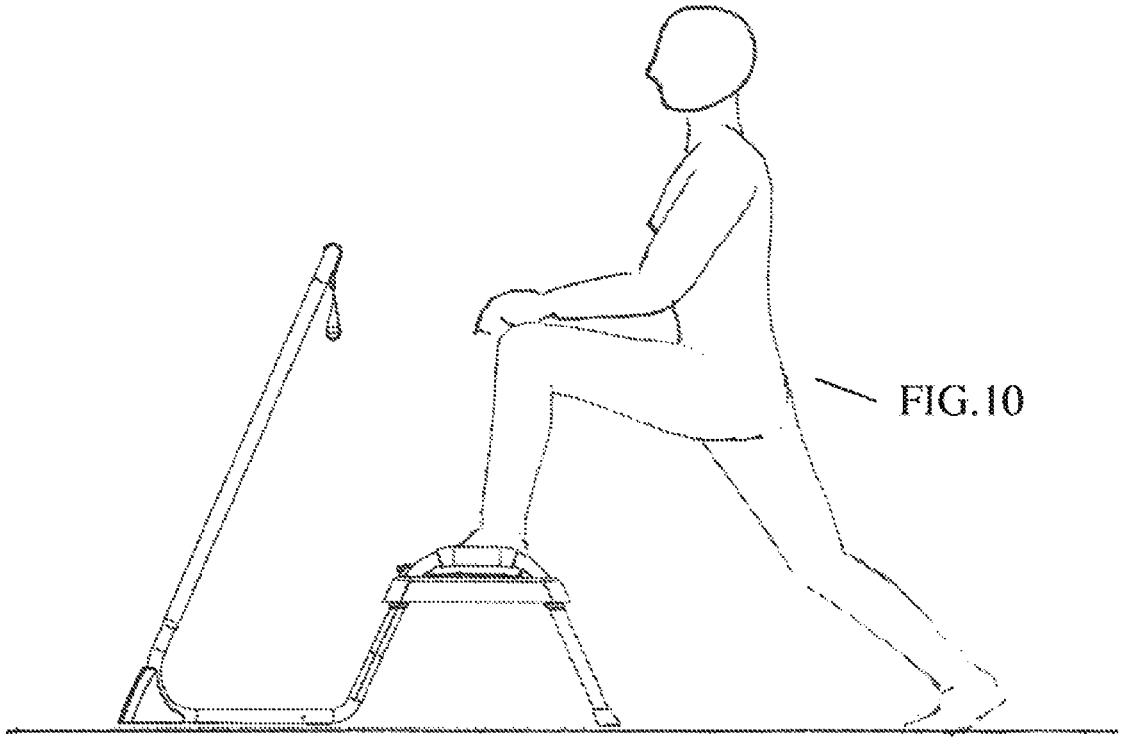
FIG. 10 shows a side view of an apparatus made in accordance with an implementation of the invention, the apparatus being used for an alternative exercise.

The elevated platform 12 may be used in a range of exercise methods. Shown is use in a lunge style movement with one foot on the floor and the alternate foot placed on the platform FIG. 10. The platform 12 may be used as a conventional step platform known to the industry while providing additional enhancements using the multiple gripping regions and the support of the frame for assistance. The secure mounting of elevated platform 12 requires no tools to maintain placement. The platform 12 is attached and removed passively yet allows use of the outer edges of the platform 12 without loss of placement or movement. This secure placement of the elevated platform 12 is the result of the relative geometry between the elevated platform 12, and the parts that comprise the front raised bar region 14.

Figure 11:
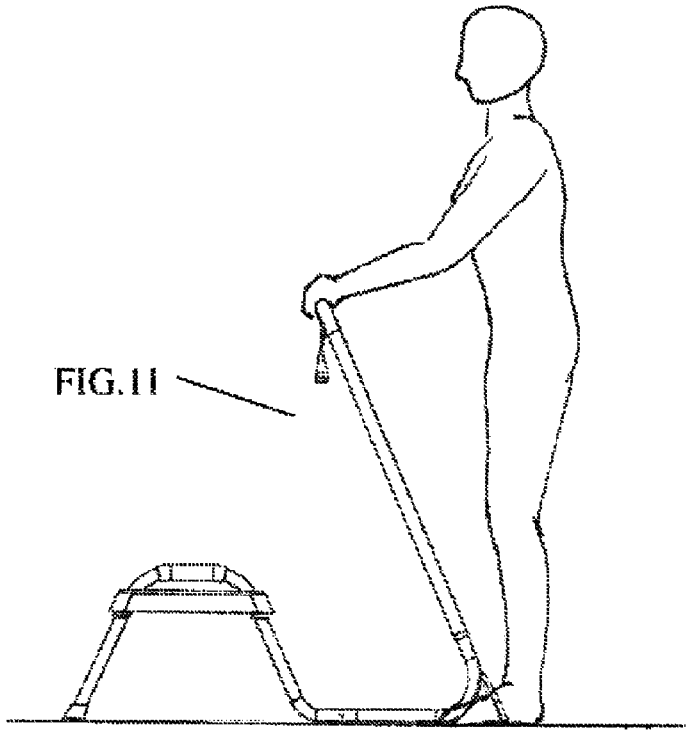
FIG. 11 shows a side view of an apparatus made in accordance with an implementation of the invention, the apparatus being used for an alternative exercise.

The apparatus of the invention may be used from various directions. From the rear as shown in FIG. 11 various movements may be completed such as with a ballet bar or balance bar.

Figure 12:
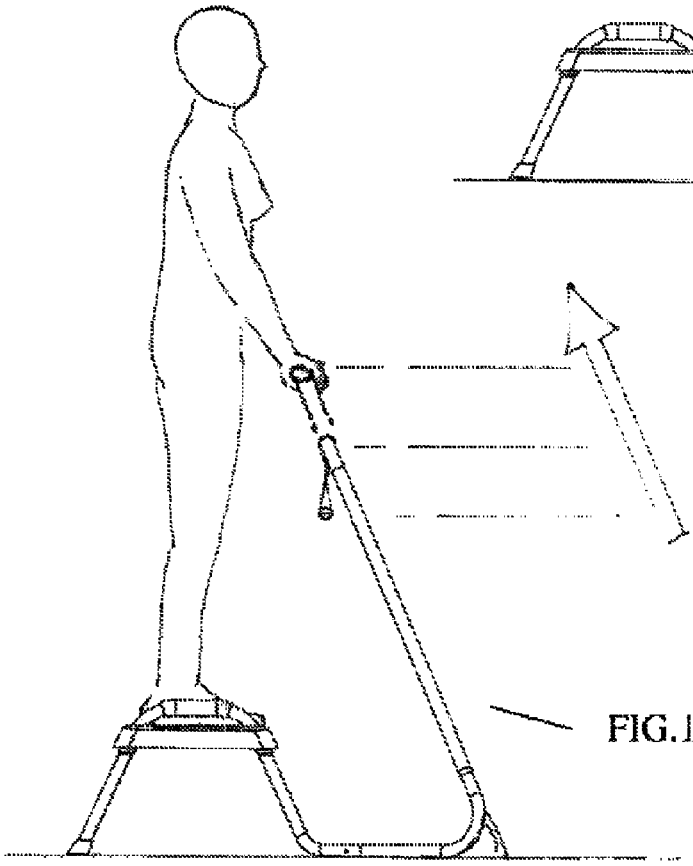
FIG. 12 shows a side view of an apparatus made in accordance with an implementation of the invention, the apparatus being used for an alternative exercise.

The horizontal bar 11 is adjustable vertically for use in various movements, as shown in FIG. 12. The adjustment and be upward or downward as needed and can be used in conjunction with the other features of the apparatus. Additionally the horizontal bar 11 in product variations may adjust pivot ably to produce a more upright angle of the upward support bar 15. Additionally machine 17 may allow various gripping positions along the length of the horizontal bar 11 as well as along the length of the upward support bar 15.

The raised front bar region 14 may also vary in vertical adjustment as well, allowing various grip positions. Additionally the raised front bar region 14 and the foam grips 16 may adjust inward or outward either dynamically or in a fixed position.

The height adjustment of the upward support bar 15. or the front bar region may occur by various methods. The upward support bar 15 is adjusted by means of spring loaded lockable spring pins 18 known to the industry. The vertical adjustment of the upward support bar 15 also occurs within a channel formed in one or both of the mating tubes to maintain rotational alignment.

The frame design of the machine 17 may vary in material, configuration, number of parts and design while still allowing similar function of the primary exercises as shown in FIG. 5 through FIG. 12. The exercises described in FIG. 5 through 12 do not define the entirety of the possible exercises.

The folding of the machine 17, may occur in various methods. The current embodiment shown in FIG. 4 uses the locking spring pins 18, to allow the parts that comprise the machine 17 to fold into a mostly flat position. The method and placement of the folding positions may vary with the same desired result to minimize the size of the machine 17.

I claim:

1. An exercise apparatus comprising a tubular frame, the frame comprising:

a raised front region comprising two parallel hand grips for completing a push-up or dip-style movement; the hand grips formed from a weight-bearing portion of the tubular frame;

a removable platform configured for standing upon;

the removable platform further configured for positioning between the parallel hand grips such that the hand grips project above the top surface of the platform when the platform is installed; and a horizontal rear support bar for completing a pull-up type movement; the rear support bar containing at least two suspended hand grips, the hand grips configured for sliding along the rear support bar;

four pivot points on the tubular frame for selectively rotating portions of the tubular frame, wherein rotation of portions of the tubular frame around the four pivot points allows for reconfiguring the exercise apparatus into a substantially flat configuration without the need to otherwise rotate any portion of the exercise apparatus;

wherein the removable platform contains two elongate openings on opposite ends of the platform, the elongate openings configured for placement over the parallel hand grips so as to be supported below the hand grips by the tubular frame of the exercise apparatus such that the platform can be removed by a lifting motion.

2. The exercise apparatus of claim 1, wherein the suspended hand grips on the rear support bar are rotatable.

3. The exercise apparatus of claim 2, wherein the hand grips have an adjustable length.

4. The exercise apparatus of claim 1, wherein the raised front region has a height that is adjustable.

5. The exercise apparatus of claim 1, wherein the horizontal support bar has a height that is adjustable.

6. The exercise apparatus of claim 4, wherein the height of the raised front region is adjusted using spring-loaded lockable pins.

7. The exercise apparatus of claim 5, wherein the height of the horizontal support bar is adjusted using spring-loaded lockable pins.

* * * * *